US009352546B2

(12) United States Patent
Chen

(10) Patent No.: US 9,352,546 B2
(45) Date of Patent: May 31, 2016

(54) SERVO-DRIVEN CYLINDER SCREEN PRINTING MACHINE

(71) Applicant: ATMA CHAMP ENT. CORP., New Taipei (TW)

(72) Inventor: Tung Chin Chen, New Taipei (TW)

(73) Assignee: ATMA CHAMP ENT. CORP., New Taipei (TW)

( * ) Notice: Subject to any disclaimer, the term of this patent is extended or adjusted under 35 U.S.C. 154(b) by 0 days.

(21) Appl. No.: 14/464,994

(22) Filed: Aug. 21, 2014

(65) Prior Publication Data

US 2016/0052255 A1 Feb. 25, 2016

(51) Int. Cl.
*B41F 15/08* (2006.01)
*B41F 15/18* (2006.01)

(52) U.S. Cl.
CPC ..... *B41F 15/18* (2013.01); *B41F 15/0809* (2013.01)

(58) Field of Classification Search
CPC ..... B41F 15/00; B41F 15/08; B41F 15/0804; B41F 15/0813; B41F 15/0809; B41F 15/0818; B41F 15/0827; B41F 15/14; B41F 15/18
See application file for complete search history.

(56) References Cited

U.S. PATENT DOCUMENTS 3,915,088 A * 10/1975 Svantesson et al. ..... 101/124
4,193,344 A * 3/1980 Ericsson ..... 101/126
4,448,124 A * 5/1984 Nagatani ..... 101/118
4,509,422 A * 4/1985 Nagatani ..... 101/118
4,783,616 A * 11/1988 Brasa ..... 388/837
4,905,985 A * 3/1990 Nagatani ..... 271/277
4,958,559 A * 9/1990 Bubley et al. ..... 101/123
5,101,722 A * 4/1992 Nagatani ..... 101/124
5,367,363 A * 11/1994 Kai et al. ..... 399/113
5,706,722 A * 1/1998 Kurten et al. ..... 101/129
5,816,149 A * 10/1998 Kagawa et al. ..... 101/128.4
5,906,158 A * 5/1999 Takai ..... 101/123
5,927,190 A * 7/1999 Yoshimoto et al. ..... 101/118
2002/0060397 A1* 5/2002 Endo ..... 271/121
2005/0041851 A1* 2/2005 McEvoy et al. ..... 382/151

* cited by examiner

*Primary Examiner* — David Banh
(74) *Attorney, Agent, or Firm* — Rabin & Berdo, P.C.

(57) ABSTRACT

A servo-driven cylinder screen printing machine includes a machine frame, a print cylinder, a direct-drive servo mechanism, a screen carrier and at least one linear servo mechanism. An infeed table and a delivery table are mounted in the machine frame at a front and a rear portion thereof, respectively, and the print cylinder is located between the infeed table and the delivery table. The direct-drive servo mechanism forms a direct-drive device connected to and driving a rotary shaft of the print cylinder to rotate at precisely controlled speed. The screen carrier is located above the machine frame and adjacent to a surface of the print cylinder. The linear servo mechanism forms another direct-drive device connected to and driving the screen carrier to linearly move reciprocatingly at precisely controller speed. Therefore, gears, tooth racks and cams are saved to avoid printing inaccuracy caused by noise and backlash in tooth drive.

17 Claims, 4 Drawing Sheets

SERVO-DRIVEN CYLINDER SCREEN PRINTING MACHINE

FIELD OF THE INVENTION

The present invention relates to a cylinder screen printing machine, and more particularly to a servo-driven cylinder screen printing machine that uses multiple independent driving devices to separately drive a print cylinder and a screen carrier thereof for performing screen printing, so that the cylinder screen printing machine has simplified mechanism design to avoid interference of synchronization accuracy and obtain increased printing accuracy.

BACKGROUND OF THE INVENTION

In a conventional mechanical screen printing machine driven by a central motor, the rotary motion of the central motor drives a feeder, an infeed table feeder, a side alignment device, a print cylinder, a screen carrier, and a sheet delivery device of the mechanical screen printing machine to operate.

In the above-structured mechanical screen printing machine, a direct-driven center shaft and flying gears provided on left and right sides of the print cylinder's axis together form a driving means. And, through engagement of the flying gears with two sprocket bars, the screen carrier is driven on both sides to move forward for printing or move backward for flooding.

However, the first conventional mechanical screen printing machine is subject to interference of the mechanical accuracy of synchronous drive of the screen carrier and the print cylinder. This is because the mechanical driving is realized via two tooth contact points between the screen carrier and the gears on the left and the right side of the print cylinder axis, and the mesh between gears will change with different rotational speeds. Therefore, accuracy in synchronization on each point of movement is required to guarantee the position between the printing material sheet, which is fixed to the print cylinder surface and rotating along with the print cylinder, and the screen carrier that horizontally moves above the print cylinder. Also, the gears having operated for a long period of time will wear down to result in increased backlash. And, inaccuracy in synchronization will cause printing inaccuracy when the backlash is large Another conventional mechanical screen printing machine using the unique stop-cylinder principle has been developed to avoid printing inaccuracy by driving the print cylinder via a screen carrier on both sides of the print cylinder, such as tooth racks. With this arrangement, there is only one contact point on each of the two tooth racks and thus the screen carrier and the print cylinder are accurately synchronized with one another without being influenced by printing speed and mass force.

While the screen printing machine using the stop-cylinder principle realizes the high synchronization accuracy, it is still difficult to control the deviation between the screen movement and the print cylinder movement because the screen carrier has a much shorter run in relation to the 360-degree cylinder movement. Thus, it is not possible at all for the screen carrier movement to be independent of the print cylinder motion on the mechanical screen printing machine.

To overcome the disadvantages of the previous two conventional mechanical screen printing machines, another screen printing machine having separate servo drives is developed. Please refer to FIGS. 1 and 2, the conventional screen printing machine with separate servo drives is driven to operate by independent drives that are electronically synchronized and controlled. More specifically, there is a first driving source 10 for driving a feeder 101, an infeed table 102 and a side alignment device 103; a second driving source 11 for driving a print cylinder 111 and a rotary shaft 112; a third driving source 12 for driving a screen carrier 121; and a fourth driving source 13 for driving a delivery belt 131. Wherein, the third driving source 12 drives free-wheel gears 124 provided on left and right sides of the screen carrier 121 via gears 123 connected to two sides of a transfer shaft 122.

However, in the above-structured conventional servo-driven screen printing machine, the screen carrier 121 is still driven via meshing of gears 123 with gears 124, and the problem of tooth backlashes still exist. Therefore, with the known servo drive designs, it is still not possible to achieve an accuracy of +/−0.03 mm covering the entire speed range.

Further, all the above-mentioned conventional screen printing machines involve a complicated structure that includes multiple sets of gears, tooth racks, cams and chains, which not only results in increased part assembling labor and time, but also accumulated part tolerance that prevents the machine from meeting the requirement for synchronization and printing accuracy.

SUMMARY OF THE INVENTION

A primary object of the present invention is to provide a servo-driven cylinder screen printing machine, which uses multiple independent driving devices to separately drive a print cylinder and a screen carrier thereof for performing screen printing. In this manner, tooth racks and gear wheels inside the cylinder screen printing machine are saved to largely reduce the mass force during the printing operation, the negative effects caused by the backslashes in the tooth drive via gears and tooth racks are avoided to enable largely upgraded screen printing accuracy, and the screen carrier can be easily installed from a lateral side of the cylinder screen printing machine.

Another object of the present invention is to provide a servo-driven cylinder screen printing machine, of which the print cylinder and the screen carrier are connected to two mutually independent driving devices. Therefore, unlike the conventional cylinder screen printing machines, the present invention does not have any synchronization problem when the screen carrier is lifted to decouple from the print cylinder or lowered to couple with the print cylinder.

A further object of the present invention is to provide a servo-driven cylinder screen printing machine that includes two independent driving sources for two lateral sides of the screen carrier, so that the left and the right side of the screen carrier can be synchronously or independently driven according to actual need in the printing operation, and different driving parameters can be input to electronically correct any deviation in the moving distance of the screen carrier.

To achieve the above and other objects, the servo-driven cylinder screen printing machine according to the present invention includes a machine frame, a print cylinder, at least one direct-drive servo mechanism, a screen carrier, and at least one linear servo mechanism. Further, a feeder and a printed sheet collecting unit are correspondingly installed at a feeding and a delivering end of the machine frame, respectively, so that the cylinder screen printing machine can perform massive and accurate printing on a large number of printing material sheets.

An infeed table is mounted in a front portion of the machine frame to form a feeding zone, and is connected to the feeder. A delivery table is mounted in a rear portion of the machine frame to form a delivering zone, and is connected to the printed sheet collecting unit. Between the feeding zone and the delivering zone of the machine frame, there is formed a printing zone.

The print cylinder is installed in the printing zone of the machine frame and has a rotary shaft and a cylinder body mounted on the rotary shaft. The direct-drive servo mechanism is connected to at least one end of the rotary shaft of the print cylinder to form a direct-drive device for driving the rotary shaft to rotate at precisely controlled rotational speed. The screen carrier is located above the printing zone of the machine frame and adjacent to a surface of the cylinder body of the print cylinder. The linear servo mechanism is connected to the screen carrier to form another direct-drive device for driving the screen carrier to linearly move above the machine frame.

In an operable embodiment of the present invention, there are included one direct-drive servo mechanism configured as a servo motor and directly installed on an end of the rotary shaft of the print cylinder, and two linear servo mechanisms configured as two linear motors separately mounted to the left and the right side of the screen carrier for driving the screen carrier to linearly move reciprocatingly between the feeding zone and the delivering zone. Further, the two lateral side of the screen carrier can be independently driven by the two linear servo mechanisms.

In another operable embodiment, there is only one linear servo mechanism installed at a center of the screen carrier for driving the screen carrier to linearly move reciprocatingly between the feeding zone and the delivering zone.

The delivery table includes a first conveyor located adjacent to the printed sheet collecting unit and a second conveyor located between the first conveyor and the print cylinder. The first conveyor is connected to and brought by a first driving motor to generate a first conveying speed the same as a synchronous speed of the printed sheet collecting unit; and the second conveyor is connected to and brought by a second driving motor to generate a second conveying speed that is properly changeable and adjustable according to a speed of the print cylinder or the delivery table.

The cylinder screen printing machine according to the present invention further includes a locating device provided between the infeed table and the print cylinder; and the locating device is connected to and brought by a synchronous motor to perform print material sheet alignment and gripper movement.

The feeder includes a sheet box for holding a stack of the printing material sheets therein, a pick-up device located above the sheet box for separating the sheets from the sheet stack one by one, an infeed transfer section located at one side of the pick-up device corresponding to the infeed table, a third driving motor connected to the pick-up device for driving the pick-up device to separate the sheets from the sheet stack one by one, and a fourth driving motor connected to the infeed transfer section for driving the infeed transfer section to operate. The fourth driving motor is also connected to the infeed table for synchronously driving the infeed table to convey the printing material sheets.

The servo-driven cylinder screen printing machine of the present invention is characterized in using two independent direct-drive devices, namely, the direct-drive servo mechanism and the linear servo mechanisms, to rotate the print cylinder and move the screen carrier, respectively, so that the print cylinder and the screen carrier work coordinately to complete the printing operation. With these arrangements, the present invention effectively saves the tooth racks, gears and cams inside the conventional screen printing machines to avoid the negative effects caused by the backslashes in the tooth drive via gears and tooth racks and enable largely upgraded screen printing accuracy.

Meanwhile, unlike the conventional cylinder screen printing machines, the screen carrier of the present invention is connected to two mutually independent direct-drive linear servo mechanisms, and therefore, there is not any synchronization problem when the screen carrier is lifted to decouple from the print cylinder or lowered to couple with the print cylinder. Moreover, since the present invention includes two independent driving sources for two lateral sides of the screen carrier, the left and the right side of the screen carrier can be synchronously or independently driven according to actual need in the printing operation. Different driving parameters can be input to electronically correct any deviation in the moving distance of the screen carrier.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
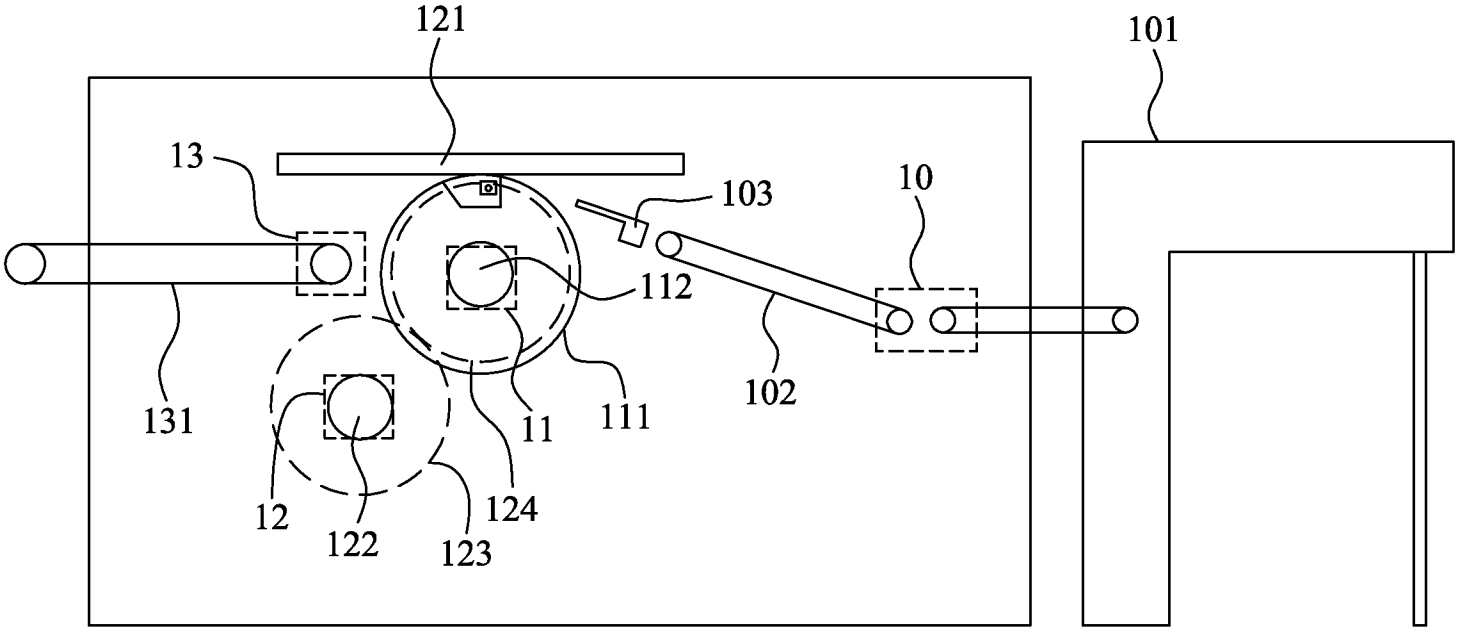
FIG. 1 (Prior Art)
FIG. 1 is a side view of a conventional cylinder screen printing machine.
Figure 2:
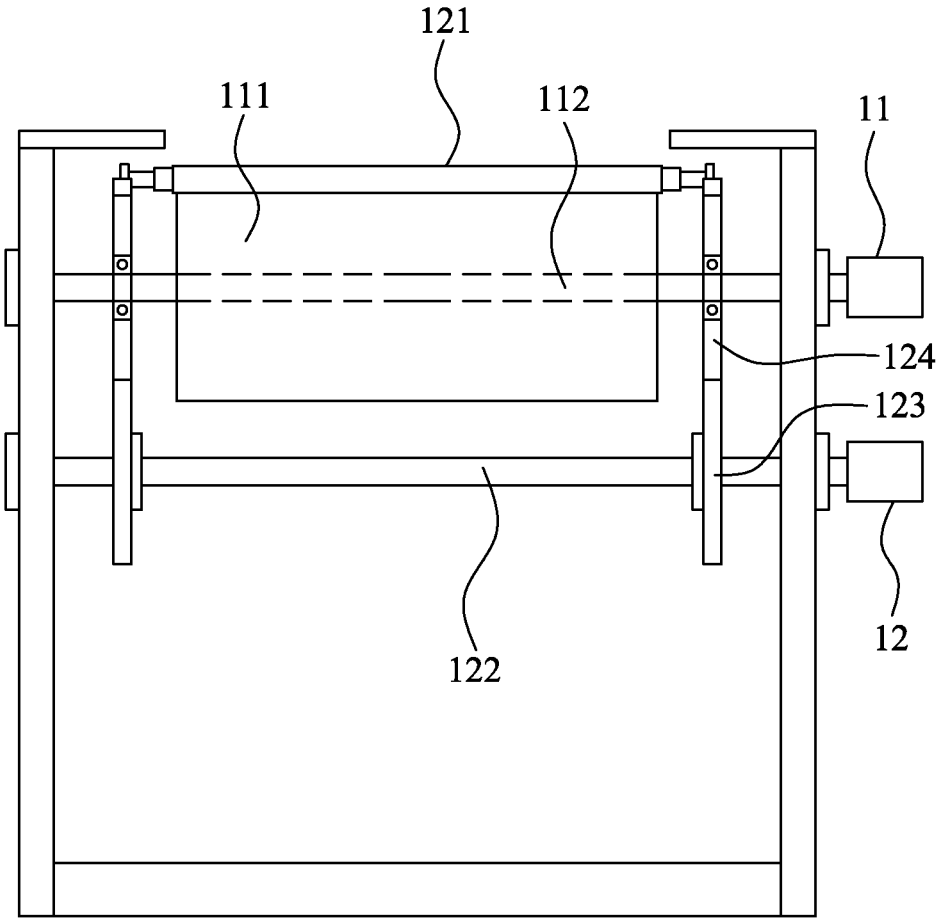
FIG. 2 (Prior Art)
FIG. 2 is an end sectional view of the conventional cylinder screen printing machine of FIG. 1.
Figure 3:
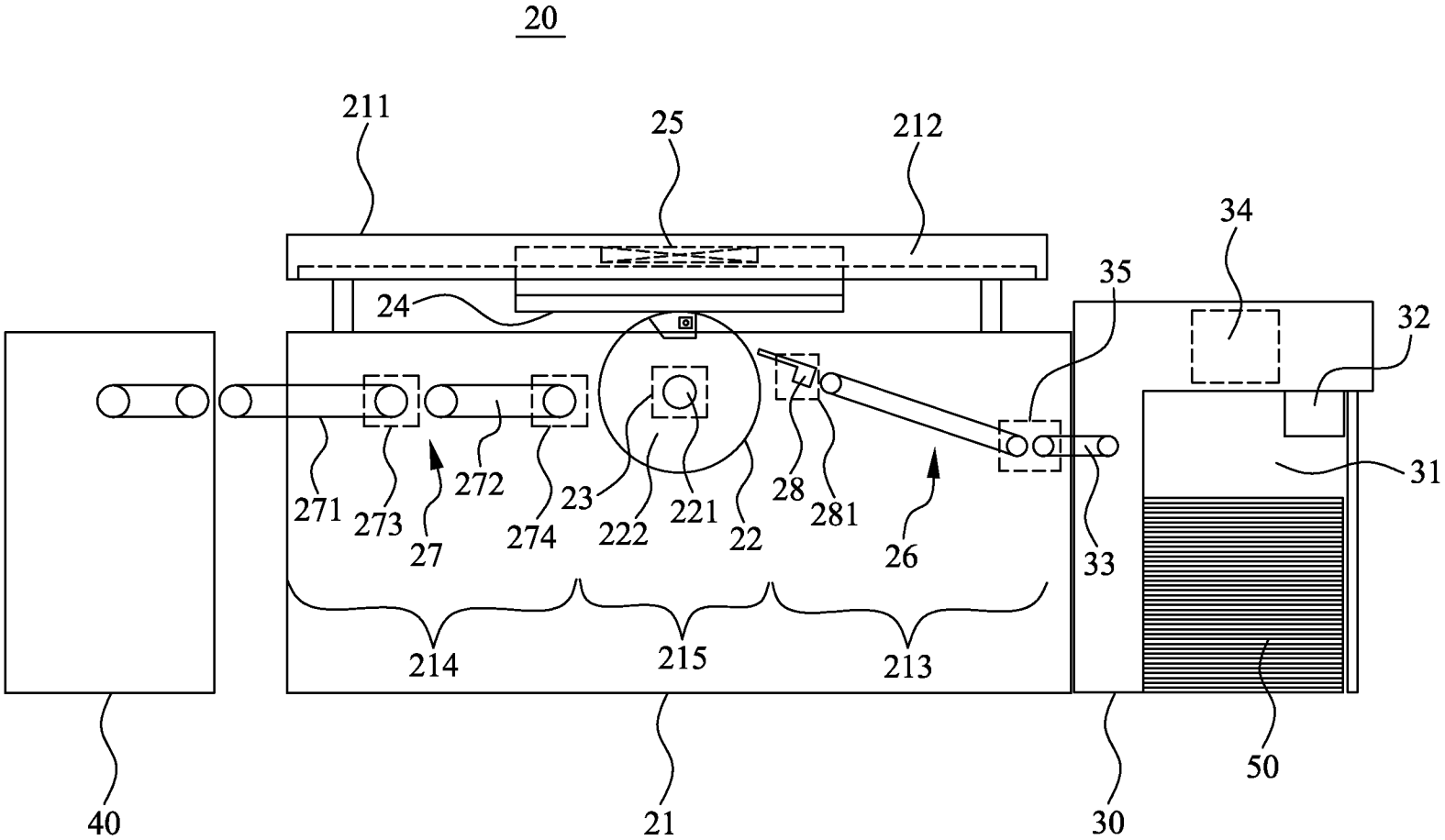
FIG. 3 is a side view of a servo-driven cylinder screen printing machine according to a preferred embodiment of the present invention.
Figure 4:
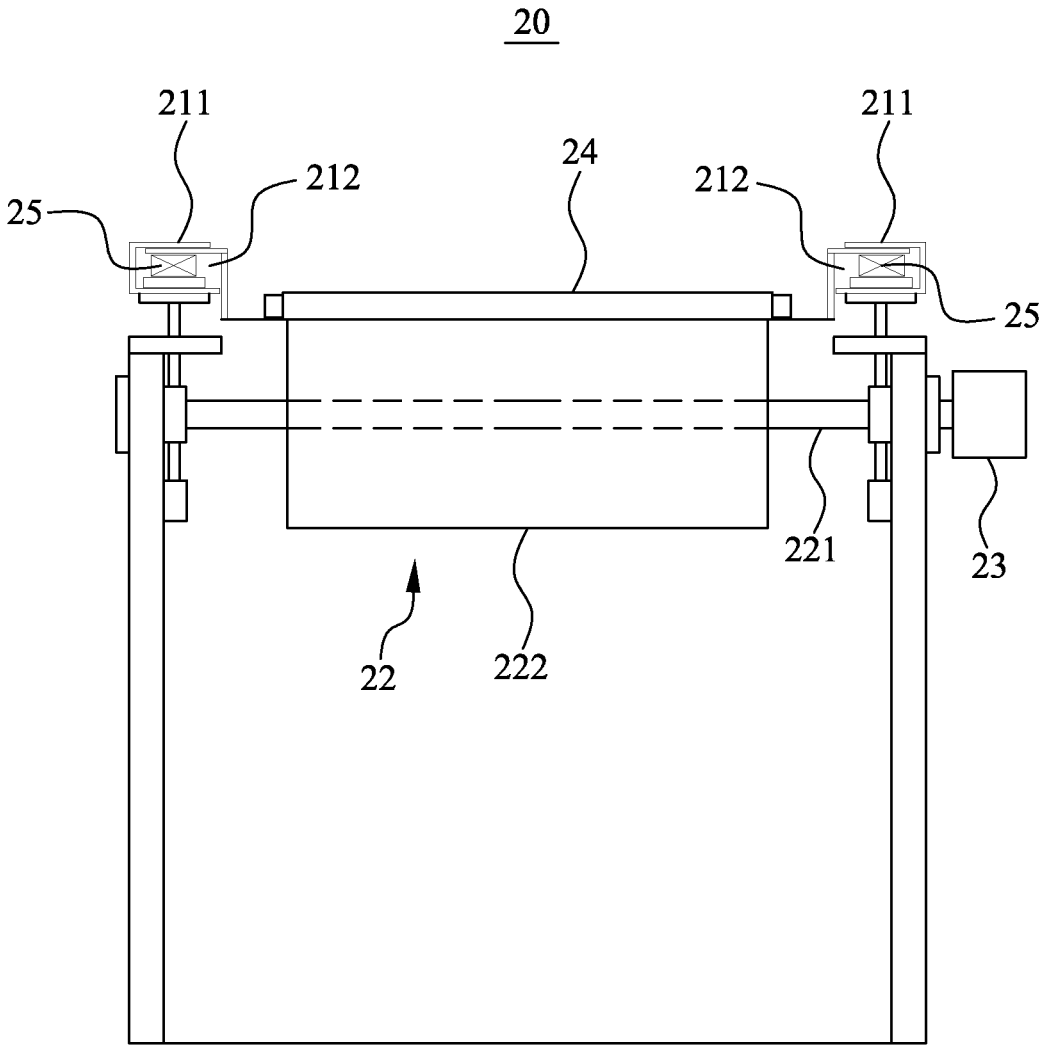
FIG. 4 is an end sectional view of the servo-driven cylinder screen printing machine according to the preferred embodiment of the present invention.

Please refer to FIGS. 3 and 4, which are side and end sectional views, respectively, of a servo-driven cylinder screen printing machine 20 according to a preferred embodiment of the present invention. As shown, the servo-driven cylinder screen printing machine 20 includes a machine frame 21, a print cylinder 22, a direct-drive servo mechanism 23, a screen carrier 24, and two linear servo mechanisms 25. The machine frame 21 has two opposite lateral side walls, which respectively have an elongated rack 211 mounted on along a top thereof. The racks 211 respectively internally define a displacement rail 212 facing toward an internal space of the machine frame 21, and the two linear servo mechanisms 25 are separately installed in the displacement rails 212. Further, a feeder 30 is correspondingly installed at a feeding end of the machine frame 21 and a printed sheet collecting unit 40 is correspondingly installed at a delivering end of the machine frame 21, so that the screen printing machine 20 can be used to perform massive and accurate printing on a large number of printing material sheets 50. For the purpose of conciseness, the printing material sheet 50 is also briefly referred to as the sheet 50 herein.

An infeed table 26 is mounted in a front portion of the internal space of the machine frame 21 to form a feeding zone 213. The infeed table 26 and the feeder 30 are correspondingly connected to one another to form a feeding means. A delivery table 27 is mounted in a rear portion of the internal space of the machine frame 21 to form a delivering zone 214.

The delivery table 27 and the printed sheet collecting unit 40 are correspondingly connected to one another to form a drying means or other operating means. Between the feeding zone 213 and the delivering zone 214 of the machine frame 21, there is formed a printing zone 215 for printing operation. Of course, other operating machines, such as a dust sticking mechanism, a gold gilding machine, a drying machine, etc., can be provided between the infeed table 26, the printing zone 215 and the delivery table 27 according to actual need in printing process.

The print cylinder 22 has a rotary shaft 221, which is installed in the printing zone 215 in the machine frame 21, and a cylinder body 222 mounted on a middle section of the rotary shaft 221. The direct-drive servo mechanism 23 is located outside the machine frame 21 and mounted to an end of the rotary shaft 221 of the print cylinder 22 to form a direct-drive device for directly driving the whole print cylinder 22 to pivotally rotate. In the illustrated preferred embodiment, the direct-drive servo mechanism 23 is configured as a servo motor. The servo motor has an encoder (not shown) driven by pulse and digital program to control the rotary shaft 221 to rotate at an accurate and stable speed. Such servo motor has many advantages, such as considerably quick acceleration and deceleration response time, quick movement, and big output power.

The screen carrier 24 is located above the printing zone 215 of the machine frame 21 and adjacent to the surface of the cylinder body 222, so that the screen carrier 24 and the cylinder body 222 together form a means to print on the sheet 50. Further, the screen carrier 24 is connected at two opposite lateral sides to the two linear servo mechanisms 25. Therefore, the linear servo mechanisms 25 installed in the displacement rails 212 formed by the two racks 211 of the machine frame 21 directly drive the screen carrier 24 to move, and form another two direct-drive devices.

In the illustrated preferred embodiment, the linear servo mechanisms 25 are respectively configured as a linear motor, which can advantageously keep high precision positioning even in a long-stroke driving. The two linear motors are separately mounted to the left and the right side of the screen carrier 24, so that the screen carrier 24 is driven simultaneously at both lateral sides to linearly move reciprocatingly between the feeding zone 213 and the delivering zone 214.

Of course, the two linear servo mechanisms 25 can independently drive the left and the right side of the screen carrier 24 according to the actual need in the printing operation. And, different driving parameters can be input to electronically correct the moving distance, so that any deviation in printing length, either too long or too short, and any skew printing can be automatically compensated.

However, it is understood the use of two linear servo mechanisms 25 is only illustrative. That is, according to the present invention, it is also possible to mount only one linear motor (not shown) to a center of the screen carrier 24 to serve as the linear servo mechanism 25 for the screen printing machine 20 of the present invention, so that the screen carrier 24 is driven at its center to linearly reciprocatingly move between the feeding zone 213 and the delivering zone 214.

Further, the delivery table 27 includes a first conveyor 271 located adjacent to the printed sheet collecting unit 40 and a second conveyor 272 located between the first conveyor 271 and the print cylinder 22. The first conveyor 271 includes an endless belt to form a first conveying space, and a plurality of rollers located in the first conveying space. The first conveyor 271 is connected to and brought by a first driving motor 273 to generate a first conveying speed the same as a synchronous speed of the printed sheet collecting unit 40. The second conveyor 272 includes an endless belt to form a second conveying space, and a plurality of rollers located in the second conveying space. The second conveyor 272 is connected to and brought by a second driving motor 274 to generate a second conveying speed that is properly changeable and adjustable according to the speed of the print cylinder 22 or the delivery table 27. With these arrangements, when the printing material sheet 50 is being transferred, there would not be any relative movement between the sheet 50 and the first and second conveyors 271, 272 caused by a difference between the conveying speeds of the two conveyors 271, 272, and damage to the underside of the sheet 50 due to slip of the sheet 50 in transferring is avoided. The printed sheet collecting unit 40 includes a third conveyor located adjacent to the first conveyor 271 of the delivery table 27. And the third conveyor includes an endless belt to form a third conveying space, and a plurality of rollers located in the third conveying space, to drive the rollers and bring the endless belt at a third conveying speed, which is a synchronous speed with the first conveyor 271 of the delivery table 27.

In the machine frame 21, a locating device 28 is further provided between the infeed table 26 and the print cylinder 22. The locating device 28 is connected to and brought by a synchronous motor 281 to perform sheet alignment, gripper movement and other operations among which synchronization is required.

The feeder 30 includes a sheet box 31 for holding a stack of printing material sheets 50 therein, a pick-up device 32 located above the sheet box 31 for separating the sheets 50 from the sheet stack one by one, an infeed transfer section 33 located at one side of the pick-up device 32 corresponding to the infeed table 26, a third driving motor 34 connected to the pick-up device 32 for driving the latter to separate the sheets 50 from the sheet stack one by one, and a fourth driving motor 35 connected to the infeed transfer section 33 for driving the latter to operate. In the illustrated preferred embodiment, the fourth driving motor 35 is also connected to the infeed table 26 for synchronously driving the infeed table 26 and the infeed transfer section 33 to transfer the sheets 50.

The transfer speeds of the third driving motor 34, the fourth driving motor 35 and the locating device 28 change according to a predetermined speed curve. The third and the fourth driving motor 34, 35 transport the sheet 50 from the sheet box 31 to the infeed table 26 in a quick but smooth manner. When the sheet 50 passes the locating device 28 to locate in front of the print cylinder 22, the transfer speed is slowed down almost to zero and the sheet 50 is smoothly transported to accurately reach its position on the print cylinder 22 and avoid scratches on the sheet 50. The design of moving the sheet 50 with independent driving motors 34, 35 and synchronous motor 281 also allows automatic correction of the arrival position of the sheet 50 on the print cylinder 22, which is also referred to as the slip correction.

The servo-driven cylinder screen printing machine of the present invention is characterized in using two independent direct-drive devices, namely, the direct-drive servo mechanism and the linear servo mechanisms, to rotate the print cylinder and move the screen carrier, respectively, so that the print cylinder and the screen carrier work coordinately to complete the printing operation. The servo-driven cylinder screen printing machine of the present invention also uses the encoder driven by pulse and digital program to ensure timely and accurate driving of all transfer and driving shafts. With the present invention, it is able to overcome the drawbacks of the conventional screen printing machines that use a very complicated driving system involving gear sets, chains and various complicated and unchangeable cam structures.

In addition, unlike the conventional screen printing machines that involve complicated and uneasily adjustably part connection, the present invention uses different servo motors to drive different mechanisms, which enables not only simplified overall structure to avoid complicated mechanism design, but also automatic compensation of any deviation in printing length, either too long or too short, and any skew printing. The present invention also effectively saves the tooth racks and gears inside the conventional screen printing machines to reduce the labor and time needed to assemble the machine. Meanwhile, the present invention avoids (1) the negative effects caused by the backslashes in the tooth drive via gears and tooth racks, (2) the inertia under high-speed printing operation, (3) the accumulated tolerance produced after assembling of the tooth racks, gears, cams and other parts, and (4) the influences by all kinds of noise and sound to thereby enable largely upgraded screen printing accuracy and increased productivity through automated mass printing.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A servo-driven cylinder screen printing machine for use with a feeder and a printed sheet collecting unit to perform printing on printing material sheets, comprising:

a machine frame including an infeed table mounted in a front portion of the machine frame that defines a feeding zone, and being connectable to the feeder, a delivery table mounted in a rear portion of the machine frame that defines a delivering zone, and being connectable to the printed sheet collecting unit, the delivery table having a first conveyor disposed adjacent to the printed sheet collecting unit, the first conveyor including an endless belt that defines a first conveying space, and a plurality of rollers disposed in the first conveying space, the first conveyor being connected to and brought by a first driving motor to a first conveying speed, and a second conveyor including an endless belt that defines a second conveying space, and a plurality of rollers disposed in the second conveying space, the second conveyor being connected to and brought by a second driving motor to a second conveying speed that is adjustable and different than the first conveying speed, and a printing zone defined between the feeding zone and the delivering zone;

a print cylinder disposed in the printing zone and, having a rotary shaft and a cylinder body mounted on the rotary shaft, the second conveyor being disposed between the first conveyor and the print cylinder;

a direct-drive servo mechanism connected to an end of the rotary shaft of the print cylinder, the direct-drive servo mechanism driving the rotary shaft and the cylinder body to rotate at a precisely-controlled rotational speed and continuously in one direction such that alternate, successive stop and print movements can be performed;

a screen carrier being disposed above the printing zone and adjacent to a surface of the cylinder body; and a linear servo mechanism connected to the screen carrier, the linear servo mechanism driving the screen carrier to linearly move above the machine frame and with the print cylinder in performing a printing operation.

2. The servo-driven cylinder screen printing machine of claim 1, further comprising:

an additional linear servo mechanism connected to the screen carrier and disposed at a left side of the screen carrier, wherein the linear servo mechanism is disposed at a right side of the screen carrier, and the linear servo mechanisms drive the screen carrier to linearly and reciprocatingly move between the feeding zone and the delivering zone.

3. The servo-driven cylinder screen printing machine of claim 2, wherein the linear servo mechanisms drive the left and the right side of the screen carrier independent of each other.

4. The servo-driven cylinder screen printing machine of claim 1, wherein the linear servo mechanism is disposed at a center of the screen carrier, and drives the screen carrier to linearly and reciprocatingly move between the feeding zone and the delivering zone.

5. The servo-driven cylinder screen printing machine of claim 1, wherein the printed sheet collecting unit includes a third conveyor, the third conveyor having an endless belt that defines a third conveying space, and a plurality of rollers disposed in the third conveying space, the third conveyor being disposed adjacent to the first conveyor of the delivery table.

6. The servo-driven cylinder screen printing machine claim 1, further comprising:

a locating device disposed between the infeed table and the print cylinder, the locating device being connected to a synchronous motor to perform sheet alignment and gripper movement.

7. The servo-driven cylinder screen printing machine of claim 1, wherein the feeder includes:

a sheet box holding a stack of the printing material sheets, a pick-up device disposed above the sheet box individually separating the printing material sheets from the sheet stack, an infeed transfer section disposed at one side of the pick-up device corresponding to the infeed table, a third driving motor connected to the pick-up device and driving the pick-up device to individually separate the printing material sheets from the sheet stack, and a fourth driving motor connected to the infeed transfer section and driving the infeed transfer section to operate.

8. The servo-driven cylinder screen printing machine of claim 7, wherein the fourth driving motor is also connected to the infeed table to synchronously drive the infeed table to transport the printing material sheets.

9. The servo-driven cylinder screen printing machine of claim 1, wherein the direct-drive servo mechanism is a servo motor.

10. The servo-driven cylinder screen printing machine of claim 1, wherein the linear servo mechanism is a linear motor.

11. The servo-driven cylinder screen printing machine of claim 1, wherein the machine frame further includes:

a left lateral side wall having an elongated rack mounted thereon, and a right lateral side wall having an elongated rack mounted thereon.

12. The servo-driven cylinder screen printing machine of claim 11, wherein the elongated racks respective define a left displacement rail and a right displacement rail.

13. The servo-driven cylinder screen printing machine of claim 12, further comprising:

an additional linear servo mechanism connected to the screen carrier and disposed in the left displacement rail, wherein the linear servo mechanism is disposed in the right displacement rail.

14. The servo-driven cylinder screen printing machine of claim 5, wherein the first conveying speed is the same as a synchronous speed of the third conveyor of the printed sheet collecting unit.

15. The servo-driven cylinder screen printing machine of claim 7, wherein the third driving motor generates a transfer speed, and the fourth driving motor generates a transfer speed.

16. The servo-driven cylinder screen printing machine of claim 15, wherein the transfer speeds of the third driving motor and fourth driving motors change according to a predetermined speed curve.

17. The servo-driven cylinder screen printing machine of claim 6, wherein a transfer speed of one of the printing material sheets is decreased responsive to passing the locating device.

* * * * *